United States Patent [19]

Svendsen

[11] Patent Number: 4,592,108

[45] Date of Patent: Jun. 3, 1986

[54] TOOL AND METHOD FOR SCARIFYING A SURFACE

[75] Inventor: John M. Svendsen, New Hope, Minn.

[73] Assignee: Tennant Company, Minneapolis, Minn.

[21] Appl. No.: 455,209

[22] Filed: Jan. 3, 1983

[51] Int. Cl.[4] ..... A47L 13/02

[52] U.S. Cl. ..... 15/4; 15/93 R; 15/236 C; 29/81 J; 30/172; 125/5; 299/41

[58] Field of Search ..... 15/236 C, 93, 4; 30/172, 173; 51/209 R, 209 DL; 125/5; 29/81 J; 299/41

[56] References Cited

U.S. PATENT DOCUMENTS

| | | | |
|---|---|---|---|
| Re. 26,637 | 7/1969 | Vaughn . | |
| 780,965 | 1/1905 | Ohsner . | |
| 2,150,806 | 3/1939 | McDermet et al. . | |
| 2,480,739 | 8/1949 | Johnson . | |
| 2,812,626 | 11/1957 | Osenberg . | |
| 3,094,731 | 6/1963 | Owen . | |
| 3,181,193 | 5/1965 | Nobles et al. . | |
| 3,197,798 | 8/1965 | Brown et al. | 15/340 X |
| 3,204,280 | 9/1965 | Campbell . | |
| 3,216,041 | 11/1965 | Walters . | |
| 3,309,279 | 3/1967 | Dresser . | |
| 3,351,046 | 11/1967 | Collins . | |
| 3,398,422 | 8/1968 | Barry et al. . | |
| 3,553,906 | 1/1971 | Hinshaw . | |
| 3,613,147 | 10/1971 | Norfleet . | |
| 3,678,532 | 7/1972 | Boyd . | |
| 3,708,880 | 1/1973 | Norfleet . | |
| 3,731,338 | 5/1973 | Walsh et al. . | |
| 3,754,297 | 8/1973 | Metz . | |
| 4,137,595 | 2/1979 | Stewart et al. . | |
| 4,148,110 | 4/1979 | Moen . | |
| 4,185,350 | 1/1980 | Fish . | |
| 4,295,274 | 10/1981 | Bricher et al. | 299/41 X |

FOREIGN PATENT DOCUMENTS

| | | | |
|---|---|---|---|
| 248612 | 5/1926 | Italy | 29/81 J |

OTHER PUBLICATIONS

Brochure, "Whirlaway", by Dresser Engineering Co., Jul. 1965.

Reprint, "New Errut Machine Removes Deposits from Industrial Floors", from Contract Journal, Jul. 16, 1970.

Brochure, "Industrial Floor Surfacer and Paint Remover", Equipment Development Co., Inc.

*Primary Examiner*—Chris K. Moore

*Attorney, Agent, or Firm*—Kinzer, Plyer, Dorn & McEachran

[57] ABSTRACT

A tool (10) and method for scarifying a surface is disclosed. Tool (10) comprises a backing plate (14) having a plurality of equally spaced brackets (16) extending downwardly therefrom. Each bracket (16) supports a pair of axles (18) on which are mounted scarifying elements (20, 20*a*). Each axle pair thereby defines leading and trailing stacks (32, 34) of cutting elements (20, 20*a*). The leading stack (32) of elements (20, 20*a*) scarifies parallel paths of soilage while the trailing stack (34) of elements (20, 20*a*) scarifies soilage between the indicated parallel paths to thereby clean a width of surface.

27 Claims, 12 Drawing Figures

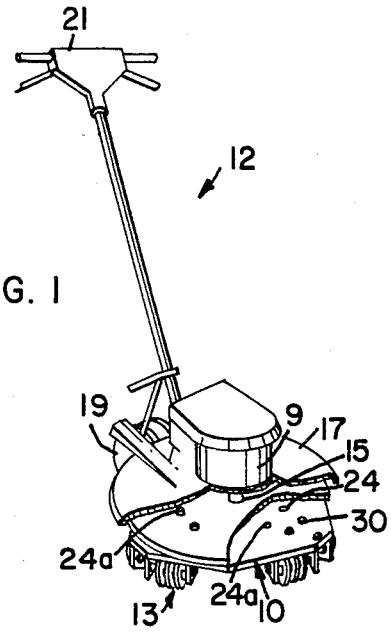
FIG. I
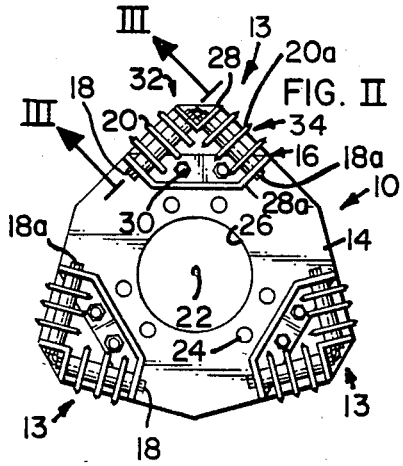
FIG. II
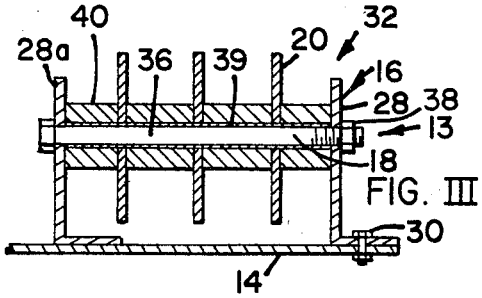
FIG. III
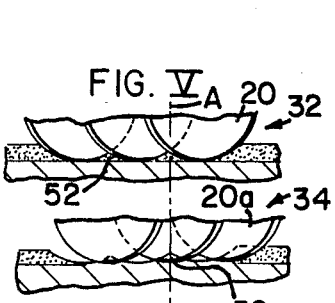
FIG. V
FIG. VI
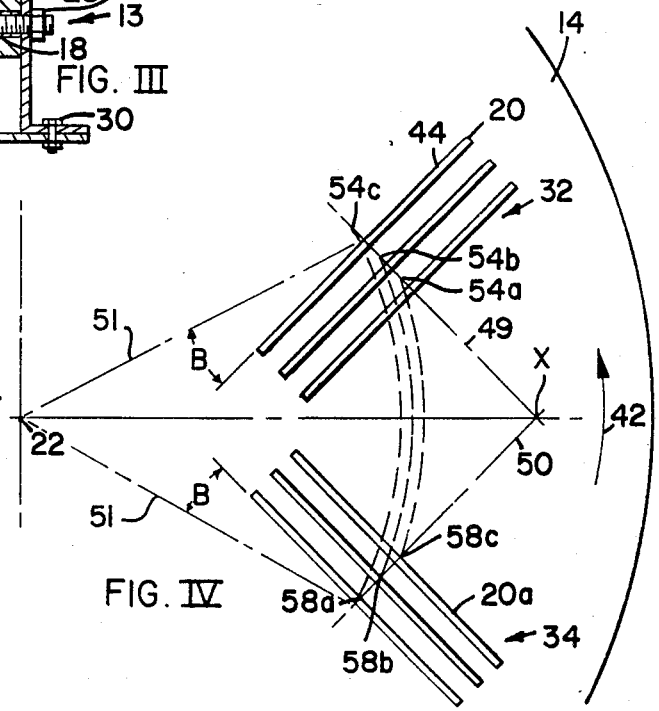
FIG. IV FIG. IX
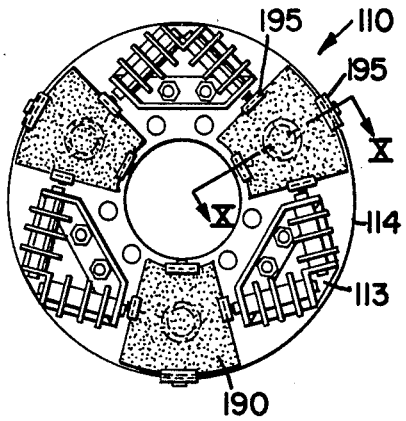
FIG. X
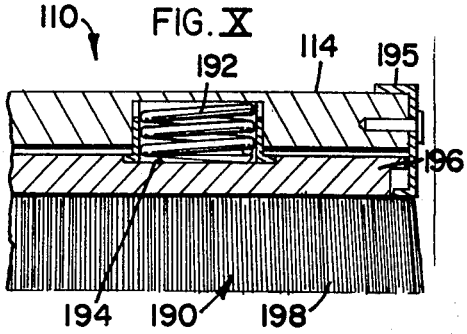
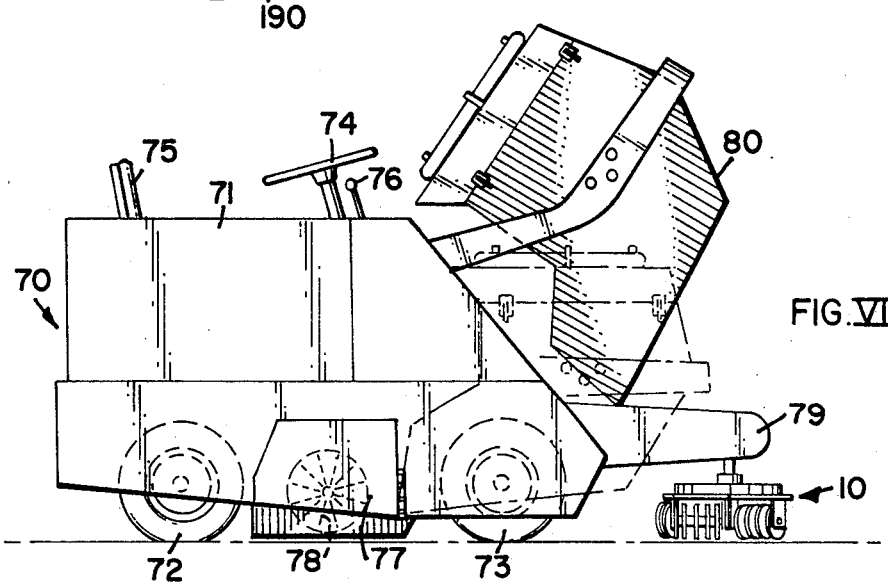
FIG. VIII
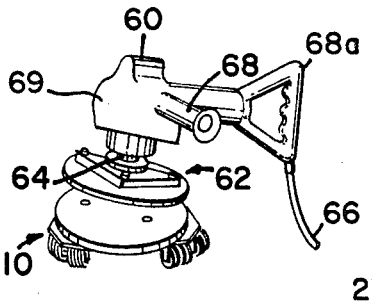
FIG. VII
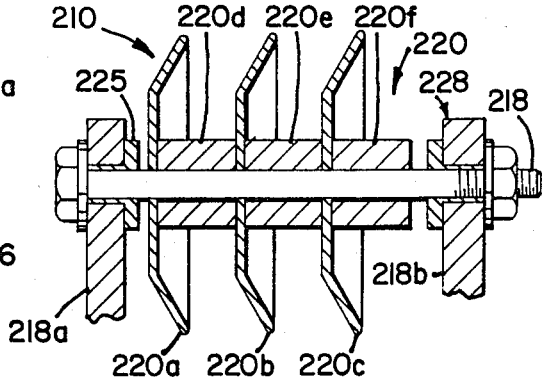
FIG. XI

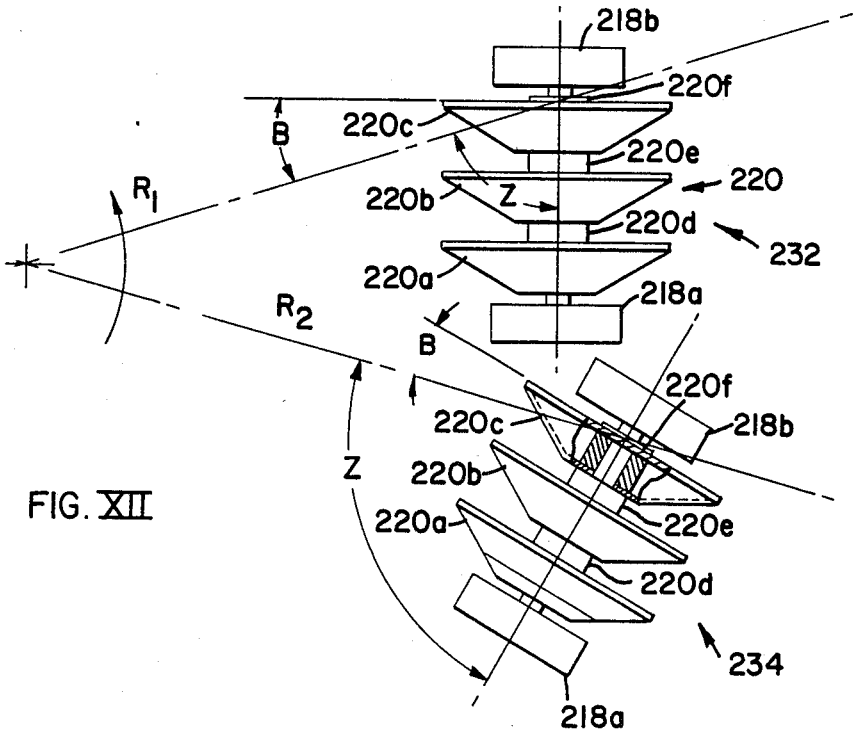
FIG. XII

TOOL AND METHOD FOR SCARIFYING A SURFACE

TECHNICAL FIELD

This invention relates to a scarifying tool and to a method for scraping or freeing coatings from a floor, roof, or other such surface.

BACKGROUND OF THE INVENTION

Factories, warehouses, workshops and other such areas often have floor surfaces on which dirt, heavy oil or other unwanted substances collect and adhere. In addition, paint and other coating materials must often be removed from walls and floors. Scarifying tools for removing such soilage or layers of coatings are known. For example, U.S. Pat. No. 4,185,350 issued to R. W. Fish shows an abrading tool for attachment to a hand-operated, rotary floor maintenance machine. The tool includes pairs of cutters centered on and perpendicular to a radial line extending from the rotational axis of the machine. The cutters roll on the surface to be worked as the machine turns the tool. The cutting elements are disc-like with a plurality of teeth around the perimeter thereof. As the floor machine translates forwardly and the tool rotates, individual cutting elements traverse a cycloidal-like path. Since the cutters are substantially tangential to the arcuate portions of the cycloidal-like path, they cut a relatively thin slice of soilage. Consequently, the cutters must traverse a relatively tight cycloid to ensure complete scraping. The machine must, therefore, turn at a very high speed or must be moved at a very slow translational speed. While the path has been described as a cycloid or cycloidal, in strict theory it is often referred to as a prolate cycloid.

Other scraping devices have used blades and discs as cutting elements. For example, U.S. Pat. No. 3,678,532 issued to R. L. Boyd shows a plurality of spaced banks of discs. Because of the wide spacing between elements, this abrading mechanism, too, must turn at a high rate in order for one bank of discs to scrape paths adjacent those of the other banks of discs and thereby completely scrape the floor.

These high speed rotary cutters lead to safety problems and, if not used carefully and skillfully, can abrade or scar the floor or surface to be cleaned.

SUMMARY OF THE INVENTION

In one embodiment, the present invention is directed to a tool for attachment to a rotary power machine for scraping a surface. The tool is comprised of first mechanism for scarifying parallel first concentric pathways in coatings on the surface, second mechanism for scarifying parallel second concentric pathways in the coatings on the surface, and structure for supporting said first and second scarifying mechanism with respect to the rotary power machine. The second pathways scarified by said second scarifying mechanism are offset from said first pathways. The term "coatings" as used herein will refer to any material one desires to remove from a base, e.g. soilage, paint, ice and the like. The present tool may also be used to cut bulges from blacktop surfaces.

In another embodiment, the tool includes a plurality of brackets depending from a backing plate. The backing plate may be attachable for driven rotation by a rotary power machine. Each bracket may support a pair of axles. Each axle of the pair may form an angle with the other axle. A plurality of disc-like cutting elements are rotatably mounted on each axle. The cutting elements are disposed so that each element cuts a wide path, which permits operation at a slower tool rotational speed. As the scarifying tool rotates, each axle pair with its cutting elements forms a leading stack and a trailing stack. Each cutting element of the leading stack cuts a cycloidal path as the machine translates across the surface. The plurality of cutting elements in the leading stack cut a plurality of parallel cycloidal paths. Ridges of soilage remain between the adjacent paths. Hence, the trailing stack has a geometry relative to the leading stack allowing the former to cut paths offset from the leading stack thereby removing the ridges. In this fashion, an entire width of surface is scraped of coating.

The present invention is, thus, particularly advantageous since its leading and trailing stacks are oriented to cooperate in removing wide parallel paths of soilage and the ridges of material between such paths. As a consequence, the scarifying tool may be turned at a relatively slow and much safer rotational speed. This further results in less likelihood of breakage of the cutting elements and less likelihood of damage to the surface. Cleaning efficiency is enhanced. Maintainability of the scarifying tool and the surfaces cleaned is made much easier. Further, the power requirements for driving the tool is much less and there is much less wear on the cutters due to the reduction in the tool rotary speed.

These and other advantages obtained by the use of the present invention may, however, be better understood by reference to the drawings which form a further part hereof, and to the accompanying descriptive matter hereinafter in which there is illustrated and described a preferred embodiment of the invention.

BRIEF DESCRIPTION OF THE DRAWINGS

FIG. I is an illustration of a machine with an attached tool in accordance with the present invention;

FIG. II is a bottom, plan view of a tool in accordance with the present invention;

FIG. III is a sectional view, taken along line III—III of FIG. II, showing a stack of cutting elements;

FIG. IV is a schematic illustration of the geometry of the cutting elements showing a leading stack and a trailing stack, and illustrating how the contact points of the trailing stack cutting elements traverse an arcuate path lying between the contact points of the leading stack cutting elements;

FIG. V is an illustration of the paths cut in soilage by the leading stack;

FIG. VI is a similar aligned illustration of a trailing stack of cutting elements and the paths cut by such trailing stack;

FIG. VII is an illustration of a hand-held machine with an attached tool in accordance with the present invention;

FIG. VIII is an illustration of a self-propelled machine with an attached tool;

FIG. IX is a bottom, plan view of an alternate embodiment of a tool in accordance with the present invention;

FIG. X is a sectional view, taken along line X—X of FIG. IX showing a yielding mechanism for supporting a brush;

FIG. XI is a sectional view similar to FIG. III but showing another cutter configuration; and FIG. XII is a plan view showing the cutters of FIG. XI.

DETAILED DESCRIPTION OF THE INVENTION

Referring now to the drawings wherein like reference numerals designate identical or corresponding parts throughout the several views, and more particularly to FIGS. I–VI, scarifying tool 10 in accordance with the present invention is shown mounted on a representative handle directed self-supported rotary power machine 12. Scarifying tool 10 in accordance with the present invention may be used on any of a number of different types of rotary power machines. The handle directed machines of FIG. I are most commonly used for floor maintenance. Hand-held devices hereinafter described and shown in FIG. VII are typically used for paint removal, barnacle removal from ships, and a variety of other applications requiring a scarifying or abrading tool. It is clear from the variety of possible applications that tool 10 may be scaled and modified accordingly depending on the particular application. It is understood, therefore, that the following disclosure discusses a representative tool 10.

As shown in FIG. I, machine 12 includes a drive motor 9 for rotating a shaft 15. A tool 10 is suitably mounted on shaft 15 for rotatably driven engagement. Of course, tool 10 alternatively may be unitary or integral with the shaft 15. Motor 9 is mounted on a frame 17 supported by wheels 19. Machine 12 may be moved and directed by an operator guiding handle 21.

Tool 10, as shown in FIG. II, includes a support member or backing plate 14 having a plurality of scarifying assemblies 13. Brackets 16 may be equally spaced on plate 14 and extend downwardly therefrom. Each of brackets 16 supports a pair of axles such as 18 and 18*a* on which equally spaced scarifying or cutting elements 20 and 20*a*, respectively, are mounted. The cutting elements 20 and 20*a* are free to rotate; thus, wearing takes place uniformly around the circumference of each cutting element. It is to be understood that there may be a greater or lesser number of scarifying assemblies 13 than the three shown in FIG. II. Also, a bracket 16 may support a single axle or as shown in FIG. II, a plurality of axles. Also there may be a greater or lesser number of cutting elements than shown.

Plate 14 has a plurality of spaced apart openings 24 for fastening elements such as bolts to pass through and attach tool 10 to a machine 12. As indicated, backing plate 14 represents a connecting structure between the working elements of tool 10 and the rotary drive apparatus of machine 12. Although a specific configuration is shown in FIG. II other equivalent structures may be devised by those skilled in the art for accomplishing the indicated scarifying function, including backing plate 14 being a unitary part of machine 12 or some other similar machine.

Brackets 16 (FIGS. II and III) each include walls 28 and 28*a* extending downwardly from backing plate 14. Walls 28 and 28*a* are perpendicular to and support each end of axle 18. Brackets 16, preferably three, are equidistantly spaced along an arc centered on backing plate 14. Brackets 16 are fastened to plate 14 with a plurality of nut and bolt combinations 30 or other fastening mechanisms. Each bracket 16 supports a pair of axles 18 and 18*a* according to a geometry as shown in FIG. IV and described hereinafter.

As tool 10 rotates, a trailing stack 34 of cutting elements 20*a* cooperates with a leading stack 32 of cutting elements 20 to remove essentially all coating within the diameter of the rotational circle traversed by the elements. A single stack 32 of elements 20 is shown in FIG. III. An axle 18 is represented by a bolt 36 extending between a pair of walls 28 and 28*a*. Bolt 36 is held in place with a nut 38. A plurality of cutting elements 20 are rotatably mounted on a hardened sleeve 39 on axle 18 and separated with spacers 40.

Cutting elements 20 are preferably equally spaced so as to cut a regular pattern of adjacent paths through the coating. The spacing between elements 20 is sufficient to avoid accumulation of cuttings there-between. The spacing separation depends on the thickness of coating material to be cut. The thickness and shape of the cutting elements 20, as well as down pressure on the tool 10, depend on the general type of coating material to be cut. Usually, a disc-like cutting element 20 may be used. However, for a strongly adhering type of coating a cup-like or other structural shape may be advisable. With a disc-like cutting element 20 it is advantageous to harden the leading or forwardmost surface. Such hardened surface then functions to self-sharpen element 20 and maintain a shearing edge as softer metal rearward is worn away.

The geometry with respect to locating cutting elements 20 and 20*a* relative to center 22 of tool 10 is shown in FIG. IV. The direction of rotation is indicated by arrow 42 thereby identifying leading and trailing stacks 32 and 34, respectively. Lines 51 extending from the center 22 to an intersection with each of the axes 49, 50 at a point where each of the elements 20, 20*a* is positioned makes an angle B with the plane of the cutting edge of each of the elements. When leading and trailing stacks of elements are aligned to cooperate in scarifying a surface as described hereinafter the angle B for each cutting element should be large enough that the cutting element 20 rotates on its axis as the tool rotates. The angle B for each cutting element should be sufficiently small that good cutting takes place. The present invention utilizes cooperating stacks of cutting elements 20 having angles B of between 15 and 75 degrees.

The axes 49 and 50 of leading and trailing stacks 32 and 34 may be disposed at an angle with respect to each other. A radial line extending to the intersection X of axes 49 and 50 preferably divides such angle into two equal portions. Alternatively axes 49 and 50 may be parallel with each other or the axes 49 and 50 may form the same angle with a radial line. Such an orientation of pairs of stacks is part of a formula for trailing stacks 34 to cooperate in removing soilage remaining after passage of leading stacks 32 as described hereinafter. Spacing between adjacent cutting elements is sufficient to assure that cuttings do not collect between elements. The spacings will generally be $\frac{1}{4}$ to $1\frac{1}{2}$ inches depending on the type of soilage or coating to be cut.

Illustrated in FIG. V is the soilage cut of a leading stack of elements 32. Since cutting elements 20 are circular, a ridge 52 of soilage material remains intermediate the path of adjacent elements 20 as the stack rotates and translates. The individual cutting elements 20*a* of trailing stack 34 are located relative to leading stack 32 to remove ridges 52 as illustrated in phantom in FIG. VI. FIGS. V and VI are aligned, as shown by line A, to show the relative paths traversed by the leading and trailing elements. It is to be understood that the trailing stack 34 may be located relatively near leading stack 32, as shown in FIG. II, or removed therefrom, as would be the case if each stack were mounted on individual brackets 16. One formula for locating stacks 32 and 34 relative to one another is illustrated in FIG. IV. Midpoints 54*a*, and 54*b* are located midway along a length on axis 49 between adjacent cutting elements 20 of leading stack 32. A point 54*c* is located forwardly of the forward most element a distance equal to one-half the distance between adjacent cutting elements. A second set of points 58*a*, 58*b* and 58*c* are located along axis 50 where the leading cutting surface of each of cutting elements 20*a* intersects axis 50. The first set of points 54*a*, 54*b* and 54*c* correspond with the second set of points 58*a*, 58*b* and 58*c* so as to have a point from each set located on a set of arcs centered on rotational center point 22. Point 54*c* and rearmost point 58*a* are on the smallest diameter arc. Larger circles include pairs of points according to the ordering indicated. With this geometry, leading and trailing stacks 32 and 34 cooperate to remove soilage from a path the width of tool 10.

To operate, a tool 10 is fastened by insertion of screws 24*a* at openings 24 into suitable openings in the rotary drive apparatus of a rotary power machine such as 12. Since tool 10 has cutting element stacks oriented as described, it has been found that machine 12 may rotationally drive tool 10 at a relatively slow rate. For example, prior art machines commonly operate at 5000 RPM, while the present machine 12 with a tool 10 may operate satisfactorily and efficiently even at about 150 RPM or lower. This, of course, results in significantly less potential damage to the surface being cleaned as well as being much safer than previous machines. This also increases the cutter life.

While tool 10 rotates, machine 12 translates across the surface so each of the plurality of cutting elements 20 traverses a cycloidal path. The leading stack 32 of a pair scarifies parallel paths in the soilage while leaving ridges 52 (FIG. VI) between the paths. Cutting elements 20*a* of trailing stack 34 scarify away the ridges 52 thereby removing substantially all soilage and providing a clean surface.

To prevent cutting elements 20 from dulling, as indicated, the leading surface of each element 20 may be hardened. The leading surface thus is not abraded away as easily as the remainder of the material thickness and, hence, retains a cutting edge.

The aggressiveness of tool 10 may be varied by changing angle B of the various cutting elements 20 and 20*a*. Additionally, as discussed hereinbefore, other parameters, such as down pressure, spacing, thickness and diameter of elements 20 and 20*a*, may be changed depending on a particular application. The cuttings may be picked up in any suitable manner such as by sweeping.

The present tool 10 is shown in one specific embodiment. However, various modifications may be made without departing from the broader scope of the present invention. Moreover, the present tool may be used on various other types of driving equipment. Suitable driving equipment may include self-propelled riding machine 70 (FIG. VIII) having a self-contained pickup system, walk behind floor maintenance machines 12 having a handle for controlling the direction of movement and small hand-held abrading machines 60 (FIG. VII). The larger machines 70 may be used for removing asphalt, heavy dirt, oil, paint or other substances built up on a generally horizontal surface such as a warehouse floor or a parking lot surface. The smaller machines 60 may be used to remove paint from walls and barnacles from ships.

A tool 10 can as well be used as a unitary part of or as an attachment to a hand-held machine 60 (see FIG. VII). Machine 60 includes a small drive mechanism 62 having a shaft 64 to which tool 10 is connected. Drive mechanism 62 may have an electric, hydraulic, pneumatic, or other power source with appropriate connecting apparatus 66. Machine 60 includes a pair of handles 68 and 68*a* or other convenient members as a portion of a frame 69 for holding and directing the machine 60.

Additionally, tool 10 may be a part of a self-propelled machine 70 as illustrated in FIG. VIII. Machine 70 as illustrated includes a main body frame 71 that has a rear wheel 72 and front support wheels 73 rotatably mounted thereon. The mobile sweeping machine is powered through a suitable power mechanism (not shown). The machine has a steering wheel 74, operator's seat 75 and other controls illustrated generally at 76 for operating the machine. Machine 70 has a brush housing 77 in which a cylindrical brush 78 is rotatably mounted. One or more scarifying tools 10 are mounted from one or more arms 79 or from a frame extending forwardly from frame 71 or hopper. For example, one tool may cover only a portion of the path being swept whereas if a plurality of tools are used the entire path may be covered. Soilage and other coatings are loosened by tools 10. Brush 78 commonly rotates counterclockwise as viewed in FIG. VIII to propel debris into hopper 80 in its lowered position supported just forwardly of brush 78. Hopper 80 may be raised to dump accumulated debris. Machine 70 is exemplary of various self-propelled machines which may utilize tools 10, and it is understood that such machines may assume a variety of other configurations.

An alternate embodiment, tool 110, is shown in FIGS. IX and X. The tool 110 is comprised of alternate scarifying assemblies 113 and brushes 190. Brushes 190 may be mounted on plate 114 using nuts and bolts or other standard fastening mechanisms. Preferably, brushes 190 are mounted so as to be movable toward and away from plate 114. The brush 190 is thus biased away from plate 114 thereby to contact the surface to be scraped with a controlled uniform face even though the brush bristles wear during usage. Thus, a spring 192 is compressed between plate 114 and a surface 194 which is a part of base 196 of brush 190. The base 196 may be suitably guided to maintain a parallel arrangement between plate 114 and base 196 such as by guides 195. Bristles 198 extend downwardly from base 196. Tool 110 is particularly advantageous on surfaces which require the small, randomly located bristles of a brush for cleaning in addition to the more general scarifying accomplished by scarifying assemblies 113.

A further embodiment of the present invention is illustrated in FIGS. XI and XII. The cutters on tool 210 are cupped to provide more aggressive cutting. Otherwise the tool 210 may be identical in construction to tool 10 shown in FIG. II. The cutters 220 preferably may be supported on a bracket 228 which comprises a pair of depending flanges 218*a* and 218*b* which are welded to the backing plates. Desirably the flanges 218*a* and 218*b* each have a hardened steel bushing such as 225 press fit into a suitable opening therein. A steel bolt 218 extends through the bushings 225 and the cutter assembly 220 is rotatably mounted on the bolt 218. The cutter assembly is an integral unit including three cupped cutters 220*a*, 220*b* and 220*c* which are welded to three spacers 220*d*, 220*e* and 220*f*. A preferred plate arrangement for the cupped cutters is illustrated in FIG. XII. In this arrangement each cutter shaft e.g. bolt 218 is disposed at the same angle with respect to a radial R1 and R2. Any angle may be used so long as the B angle for each cutter is in the range of 15 to 75 degrees. The trailing cutter 234 is offset with respect to the leading cutter 232 so that cutter 234 removes the ridges left by cutter 232.

When using cupped cutters such as in FIGS. XI and XII, the wear of the cutters will cause the overall path of each individual cutter to change radially in or out, while all of the cutting paths will remain parallel throughout the life of the cutters. If the cutters are disposed with their axles at an acute angle Z to the radius, such as in FIG. 12, the overall cutting path of each individual cutter will decrease in radius as they wear. On the other hand, if the cutters are disposed with their axles at an obtuse angle to the radius, the overall cutting path of the individual cutters will grow as the wear of the cutters takes place. At the same time, the offset relationship of the individual cutters in one group relative to the individual cutters in the other group will remain the same.

Although the foregoing description has given numerous characteristics and advantages of the present invention, together with details of structure and function, it is to be understood, as previously indicated, that the disclosure is illustrative only. Therefore, any changes made, especially in matters of shape, size and arrangement, to the full extent intended by the general meaning of the terms in which the following claims are expressed, are within the principle of the invention.

What is claimed is:

1. A tool for connection to a rotary power machine for removing a coating from a surface, said tool comprising:

first disc-like means for scarifying a plurality of parallel first pathways in the coating on the surface leaving a plurality of ridges intermediate said first pathways;

second disc-like means for scarifying a plurality of parallel second pathways in the coating on the surface, all of said second pathways being intermediate said first pathways and serving to remove coating intermediate said plurality of first pathways; and separate support means for supporting said first and second scarifying means with respect to said rotary power machine.

2. A tool in accordance with claim 1, wherein said first and second scarifying disc-like means each include an axle supporting a plurality of rotatable discs thereby forming an axle pair, said axles in said axle pair being supported by said supporting means.

3. A tool in accordance with claim 2 wherein said supporting means includes a backing plate having a plurality of depending brackets for carrying said axles, said backing plate having a center, said brackets being equidistantly spaced along an arc around said center.

4. The tool of claim 2 wherein said first and second axles are parallel with each other.

5. A tool in accordance with claim 1 wherein said first and second scarifying means each include a plurality of disc-like scarifying elements said elements being supported in a spaced apart relationship on first and second non-parallel axles.

6. The tool of claim 5 wherein said first and second axles are disposed at an angle with respect to each other.

7. The tool of claim 6 wherein a radial line extending from the center of said tool to the intersection of the centerlines of said first and second axles equally divides the angle between said axles.

8. A tool for a rotary power machine for scarifying layers from surfaces, said tool having a center for alignment with an axis of rotation of said machine, said tool comprising:

means for cutting the layers from a surface, said cutting means including a plurality of pairs of stacks of cutting elements, said pairs including a leading stack and a trailing stack, each of said stacks including cutting elements, all of said trailing cutting elements being misaligned with said leading cutting elements to remove paths of layers between the paths of layers removed by the leading cutting elements; and means for supporting said cutting means with respect to said rotary power machine.

9. A tool in accordance with claim 8 wherein the cutting edge of each cutting element forms an angle X with a radial line extending from the center of said tool, said angle having a magnitude of between 15 and 75 degrees.

10. A tool in accordance with claim 8 wherein said cutting elements each have an edge with a hardened side allowing said elements to self sharpen.

11. A tool in accordance with claim 8 wherein said cutting elements are cup-shaped.

12. A tool for removing coatings from a surface, said tool comprising:

a support member for attachment to a rotary power machine, said support member having a center;

a plurality of pairs of axles mounted on said support member;

a plurality of scarifying elements mounted on each axle, all of said scarifying elements on one axle of each said pair removing paths of coatings between the paths of coatings removed by the scarifying elements on the other axle of each said pair, thereby scraping a width of coatings from said surface.

13. A scarifying tool for attachment to a rotary power machine for removing coatings from floor surfaces, said scarifying tool comprising:

a backing plate for rotatable attachment to said rotary power machine, said backing plate having a center in common with said tool for alignment with an axis of rotation of said rotary power machine;

a plurality of brackets attached to said backing plate and equidistantly spaced along an arc centered on said tool;

a plurality of pairs of axles, each said pair being attached to a particular one of said brackets, each said axle defining an axis, the intersecting axes of said pair of axles forming equal angles with a radial line extending from the center of said backing plate and passing through the intersection of the axes of said axles; and a plurality of rotatable disc-like cutting elements mounted on each of said axles, each of said cutting elements being disposed to form an angle B with a line extending from the rotational center of said tool, each axle pair forming a leading stack and a trailing stack of said elements, whereby the leading stack of said elements strips a plurality of pathways and the trailing stack of said elements cooperates with said leading stack to strip regions between adjacent said pathways thereby uniformly removing coatings from a floor surface.

14. A tool in accordance with claim 13 wherein said angle B has a magnitude of at least 15 degrees.

15. A tool in accordance with claim 14 wherein said angle B has a maximum magnitude of 75°.

16. A tool in accordance with claim 8 wherein a first set of points located on the axis of said leading stack comprise midpoints between adjacent cutting elements and wherein there is a second set of points located on the axis of said trailing stack, each point in said second set being located on a leading surface of one of said cutting elements in said trailing stack, one of said points from each of said first and second sets lying on an arc centered at the center of said tool, said points in said first and second sets corresponding to form a set of circles which define the location of the cutting elements in said trailing stack with respect to the cutting elements in said leading stack.

17. An apparatus for scarifying surface material comprising:

frame means;

a tool supported by said frame means having spaced scarifying means for cutting parallel first and second groups of pathways in soilage from said surface, substantially all of the pathways in the second group being intermediate the pathways in the first group; and means for rotatably driving said tool.

18. An apparatus in accordance with claim 17 including a plurality of wheels for supporting said frame means with respect to said surface and a handle for directing movement of said apparatus.

19. An apparatus in accordance with claim 18 including means for self-propelling movement of said apparatus including means for controlling said movement.

20. An apparatus in accordance with claim 17 wherein said frame means includes a handle for controlling the direction of movement of said scarifying apparatus.

21. A tool for a rotary power machine comprising:

a disc-like backing plate;

peripherally spaced scarifying means attached to said backing plate for scarifying first and second groups of pathways along a surface, the pathways of said second group all being offset from the pathways of said first group and intermediate between respective adjacent pairs of them;

means for brushing said surface, said brushing means being located adjacent to said scarifying means to cooperate therewith; and means providing a driving relationship between said scarifying and brushing means and said rotary power machine.

22. A tool in accordance with claim 21 wherein said scarifying means includes a plurality of stacks of cutting elements and said brushing means includes a plurality of brush elements, said brush elements and said stacks of cutting elements being alternately located.

23. A tool in accordance with claim 22 wherein said brushing means includes means for biasing said brush elements downwardly.

24. A scarifying tool for a rotary power machine comprising:

a disc-like backing plate;

circumferentially spaced scarifying means attached to said backing plate for scarifying first and second groups of pathways along a surface, each one of said second group of pathways being offset from a respective surrounding pair of said first group of pathways; and means for providing a driving relationship with a rotary power machine.

25. A scarifying tool for attachment to a rotary power machine for removing coatings from floor surfaces, said scarifying tool comprising:

a backing plate for rotatable attachment to said rotary power machine, said backing plate having a center in common with said tool for alignment with an axis of rotation of said rotary power machine;

a plurality of brackets attached to said backing plate and equidistantly spaced along an arc centered on said tool;

a plurality of pairs of axles, each said pair being attached to a particular one of said brackets; and a plurality of rotatable disc-like cutting elements mounted on each of said axles, each axle pair forming a leading stack and a trailing stack of said elements, whereby the leading stack of said elements strips a plurality of pathways and the trailing stack of said elements cooperates with said leading stack to strip regions between adjacent said pathways thereby uniformly removing coatings from a floor surface.

26. The structure of a claim 17 further characterized in that the frame means include a debris hopper, a plurality of wheels for supporting the frame means with respect to a surface to be cleaned, and a sweeping brush on the frame means for sweeping surface material removed by the scarifying tool into the hopper.

27. The structure of claim 17 further characterized in that the scarifying means includes a plurality of cutting elements in the form of discs, the leading face of each disc being substantially harder than the trailing face so that the discs will be self-sharpening.

* * * * *